United States Patent [19]

Booth, Sr. et al.

[11] Patent Number: 4,824,090

[45] Date of Patent: Apr. 25, 1989

[54] AUTOMATICALLY SETTING THE PAPER PATH COMPONENTS OF A REPRODUCTION MACHINE IN ACCORDANCE WITH THE SIZE COPY SHEET BEING PROCESSED

[75] Inventors: Ronald P. Booth, Sr., Pittsford; Joseph S. Calcagno, Rochester, both of N.Y.

[73] Assignee: Xerox Corporation, Stamford, Conn.

[21] Appl. No.: 444,634

[22] Filed: Nov. 26, 1982

[51] Int. Cl.[4] ..... B65H 5/22

[52] U.S. Cl. ..... 271/3.1; 271/171; 271/254; 271/223; 355/35

[58] Field of Search ..... 271/3.1, 171, 223, 224, 271/253, 254, 255, 258, 259, 263; 355/3 SH, 14 SH

[56] References Cited

U.S. PATENT DOCUMENTS

| | | | |
|---|---|---|---|
| 3,592,464 | 7/1971 | Kanda | 271/223 |
| 3,944,356 | 3/1976 | Hayne | 355/3 R |
| 4,211,482 | 7/1980 | Arai et al. | 355/8 |
| 4,236,808 | 12/1980 | Tusso et al. | 355/3 SH |
| 4,260,248 | 4/1981 | Murata et al. | 355/60 |
| 4,277,163 | 7/1981 | Ikesue et al. | 355/14 R |
| 4,277,165 | 7/1981 | Wada et al. | 355/55 |
| 4,317,138 | 2/1982 | Bryah et al. | 271/259 |
| 4,351,606 | 9/1982 | Franko | 355/14 R |
| 4,440,487 | 4/1984 | Miura | 355/3 SH |

OTHER PUBLICATIONS

IBM Tech. Disc. Bull., vol. 24, No. 1B, Jun. 1981, M. Kida, pp. 547, 548.

Xerox Disclosure Journal–vol. 1, Nos. 9/10, Sep./Oct., 1976, pp. 41–42.

*Primary Examiner*—Joseph J. Rolla

*Attorney, Agent, or Firm*—Frederick E. McMullen

[57] ABSTRACT

A reproduction machine having a duplex tray for processing duplex copies and copy sheet inverter, each with an adjustable back stop for adjusting the duplex tray and inverter size in accordance with the copy size being processed. To enable automatic operation, a control which includes sensors disposed in the path of the copy sheets is provided for measuring the size of the first copy sheet as the copy sheet is being processed and adjusting the duplex tray and inverter back stops in accordance with the size copy sheet determined.

4 Claims, 17 Drawing Sheets

FIG. 3
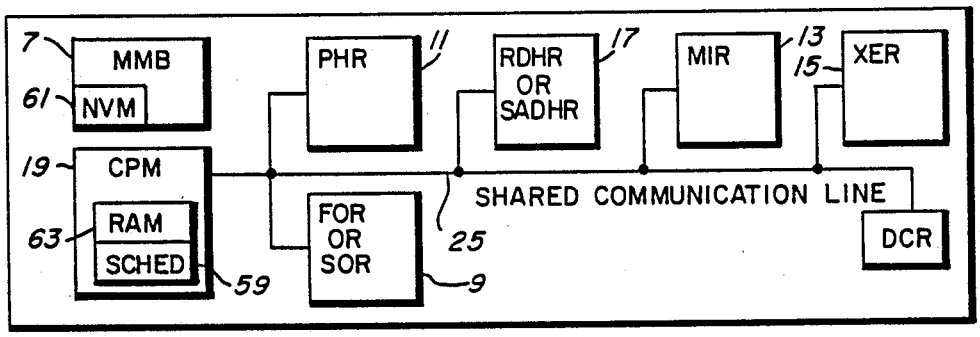
FIG. 4
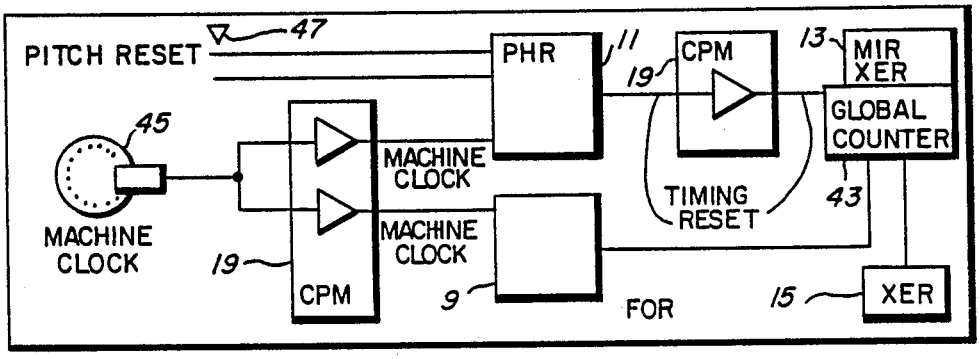
FIG. 5
64
COPY INFORMATION BYTE
| FEED / NO FEED | PURGE | ENDSET | INVERT | DESTINATION | | SOURCE | |
|---|---|---|---|---|---|---|---|
| X | X | X | X | X | X | X | X |

FOWARD (FWD)
REVERSE (REV)
HOME
M-1
62
60
70
65
102
90
94
97
83
71
69
69'
72
101
95
78
68

DELTA COUNT
SECOND EVENT @ MC
FIRST EVENT @ MC
CALL MIR
DIGITAL MC (FIRST EVENT)
PHR
CALL
DIGITAL MC (SECOND EVENT)
GLOBAL COUNTER
43
MACHINE CLOCK
45
49'
47
COMPARE
>129
<88
<54
61
NVM
19
CONTROLLER (CPM)
220 MS
490 MS
910 MS
OPERATE DUPLEX BACKSTOP MOTOR M-2
220 MS
490 MS
910 MS
OPERATE INVERTER BACKSTOP MOTOR M-3
DUPLEX SIDE ONE SELECTED
INVERTER SELECTED
BACK STOP IN HOME POSITION

DRIVE TO SET DUPLEX AND INVERTER BACKSTOPS (60 Hz)

(NOTE:) FOR 50 Hz, TIMES ARE 260 MS(8.50"), 590 MS(8.27") AND 1100 MS(8.00").

TABLE I

| Sheet Classification | Sheet Dimension (in direction of sheet feed) inches | Associated Count Stored in NVM 61 for Comparison |
|---|---|---|
| 1 | 8.66 (220mm) | > 545 |
| 2 | 8.50 (216mm) | > 535, < 545 |
| 3 | 8.27 (210mm) | > 495, < 535 |
| 4 | 8.00 (203mm) | > 495 |

FIG. 14

TABLE II

DESCRIPTION:

- INITIALIZE PAPER HANDLING MODULE INIT_PHM;
- INITIALIZES PAPER HANDLING INTERLOCKS, AND RAISES THE MAIN AND AUX. TRAY (AND DRIVES DUPLEX AND INVERTER BACKSTOPS FORWARD)

```
ENTER;
   START MONITOR_INTERLOCKS;
   IF  RDR#INLK = CLOSED THEN BEGIN;
       START MAIN_ELEV (RAISE@TRAY);
       START AUX_ELEV (RAISE@TRAY);
   END;  /* IF */


   IF  (MARKET@REGION) & FXMASK) = FX THEN BEGIN;
       DUP$FWD <- ON;
       WAIT 2 SEC:
       DUP$FWD <- OFF;
   END;  /* IF */
   ELSE BEGIN; /* NON-FX MACHINE */
       IF  (FEAT@CONFIG & BCKSTP@MASK) = BCKSTOPENABLED THEN BEGIN;
           DUP$FWD <- ON;
           WAIT 600 MS;
           DUP$FWD <- OFF;
   END;  /* IF */
   END;  /* ELSE */
END;  /* ENTER */
```

LEGEND:

| | |
|---|---|
| = | equal to |
| FX | machine intended for foreign sale (i.e. Japan) |
| DUP FWD | Motors M-2, M-3 energized in FORWARD direction to move backstops 65, 116 away from HOME position (WAIT 2 SEC) |

*FIG. 15*

TABLE III

CYCLUP_PHM

DESCRIPTION: • THE PAPER HANDLING MODULE IS CYCLED_UP BY THIS PROCEDURE WHEN START PRINT IS PUSHED

```
ENTER;

   IF  (DIAG@SETUP@INHIBITS & FEED@MASK)  =  CLEAR THEN BEGIN;
       IF (SIDE@ ! = SIDE2) \ (PURGE@PATH = TRUE) THEN BEGIN;
           IF JOB@SELECTION (TRAY) = MAIN THEN BEGIN;
               START PRF_MN_FDR;
           END;
           ELSE BEGIN;    /* MUST BE AUX    */
               START PRF_AUX_FDR;
           END;
       END;
       IF  (JOB@SELECTION (FORMAT) & (DUPLEX@SELECTED) ! = SIMPLEX THEN BEGIN;
           DUP$MTRS <- ON;
           IF  (FEAT@CONFIG & BACKSTOP@MASK) = BACKSTOP@IN THEN BEGIN;
               IF  (SIDE@ ! =  SIDE2)
                   START ADJUST BACKSTOP;
               END;   /*  IF   */
           END;   /*  IF   */


END;   /*  IF   */
ELSE BEGIN;

       IF ((SADH@DOCUMENT  \ SADH@SELECTED = 1) & (QUANTITY@SELECTED = 1) &
       ((JOB@SELECTION (OUTPUT)  &  OUTPUT@MASK) = TOPTRAY) THEN BEGIN;

               START STARE_HANDLER (FSRSTATE\GOBUSY);
               START ADJUST_BACKSTOP;
               CHK@TRAY@STATUS <- SET;
           END;   /*  IF   */
       END;   /*  IF   */
   END;   /*  IF   */
END;   /*  ELSE    */
```

LEGEND:

| | |
|---|---|
| = | equal to |
| ! = | not equal to |
| FX | machine intended for foreign sale (i.e. Japan) |
| PRF MN FDR | prefeed main feeder (tray 34) |
| PRF AUX FDR | prefeed auxiliary feeder (tray 36) |

FIG. 16

TABLE IV

ADJUST_BACKSTOP;

```
ENTER;     /*  MAIN PROCEDURE */
   CALL   MIR_DIGITAL_MC (IO_VAL (PRF#XFER,PAPER@))

RETURNS MSB (FIRST@EVENT@MC) , LSB (FIRST@EVENT@MC);
CALL PHR_DIGITAL_MC(IO_VAL (REG#FNGR, TRUE@))
RETURNS MSB (SECOND@EVENT@MC) , LSB (SECOND@EVENT@MC);
DELTA@MACH@CLK <- (SECOND@EVENT@MC - FIRST@EVENT@MC);
DELTA@MACH@CLK <- (DELTA@MADH@CLK + PACK@ORD (0,CFF@FORM@SIZE ));
/*  HOME BACKSTOP */
DUP$REV <- ON;
IF  MARKET@REGION = RX50 THEN BEGIN;
    RANGE1 <- H5ORNG1;
    RANGE2 <- H5ORNG2;
    RANGE3 <- H5ORNG3;
    WAIT 1200 MS;     /*  50 HERTZ  */
END;  /*  IF  */
ELSE BEGIN;
    RANGE1 <- H6ORNG1;
    RANGE2 <- H6ORNG2;
    RANGE3 <- H6ORNG3;
    WAIT 1010 MS;     /*  60 HERTZ  */
END;  /*  ELSE  */
DUP$REV <- OFF;
/*  POSITION BACKSTOP  */
IF DELTA@MACH@CLK > 545 THEN BEGIN;
END;  /*  IF  */  /* RANGE 0  */
ELSE BEGIN;
    IF DELTA@MACH@CLK > 535 THEN BEGIN;
        RANGE <- RANGE1;  /* 220 MS (60) 260 MS (50) */
    END;  /*  IF  */
    ELSE BEGIN;
        IF DELTA@MACH@CLK < 495 THEN BEGIN;
            RANGE <- RANGE3;  /* 910 MS (60) 1100 MS (50) */
        END;  /*  IF  */
        ELSE BEGIN;
            RANGE <- RANGE2;  /* 490 MS (60) 590 MS (50)  */
        END;  /*  ELSE  */
    END;  /*  ELSE  */
END;  /*  ELSE  */
WAIT 100 MS;
OPTMIZE 1;
DUP$FWD <- ON;
WAIT RANGE MS;
DUP$FWD <- OFF;
MOVE@BACKSTOP <- 0;
    /*  ENTER */
```

FIG. 17A

LEGEND:

| | |
|---|---|
| MIR: | MIR 13 |
| MC: | Machine Clock (Global Counter 43). |
| VAL: | Value |
| PRE#XFER: | Pretransfer (pretransfer jam detection system 49). |
| PHR: | PHR 11 |
| CLK: | Clock |
| <- | Move right side value (may be a constant or variable) into left side variable. |
| H50, H60 | 50/60 cycle Herz. |
| RNG: | Range (refers to preestablished copy sheet size designations stored in NVM 61. |

| | | |
|---|---|---|
| DUP REV: | Duplex Reverse | Motors M-2, M-3 operated in reverse or forward direction to move backstops 65, 116 toward or away from HOME. |
| DUP FWD: | Duplex Forward | |

*FIG. 17B*

AUTOMATICALLY SETTING THE PAPER PATH COMPONENTS OF A REPRODUCTION MACHINE IN ACCORDANCE WITH THE SIZE COPY SHEET BEING PROCESSED

This invention relates to a reproduction machine or copier, and more particularly to a system for automatically setting the paper path components in response to the size of the copy sheet being processed.

Modern day high speed reproduction machines or copiers enable the operator to perform a variety of different copy functions such as simplex copying, duplex copying, sorting, collating, stapling, and the like. However, the addition of these various and sundry features often comes at the expense of additional burdens on the user or operator in the form of machine set ups and adjustments that are required before the feature can be implemented. The aim today, of course, is to provide a machine international in nature, that is, a machine that may be employed with the various copy sheet sizes that are indigenous to the various countries of the world. For example, in the United States, the current copy sizes are $8\frac{1}{2}\times 11$, $11\times 14$, and the international A size. The desire to enable a machine to accommodate a multitude of sheet sizes such as exemplified above, has in some cases led to the imposition on the user or operator of certain manual tasks that must be performed before the machine may be used. In some cases, this requirement may not only be burdensome and time consuming but may also because of the nature of the machine be difficult as for example where the part to be adjusted is difficult to access.

In attempting to make a machine that is truly worldwide, the various and sundry sheet sizes used in the different countries of the world becomes a problem. For if the operator or user must open up the machine and make size adjustments to operating components such as the duplex tray or inverter every time a different size copy sheet is programmed, a substantial and perhaps intolerable burden may be placed on the operator. This is especially true in the case where adjustments to the duplex tray and/or inverter must be performed manually since these components are normally difficult to access. And of course this would be in addition to need to periodically access the paper tray or trays to replenish the paper supply although in that case the paper trays are usually designed and located to facilitate access and loading.

Attempts to simplify and reduce the burden on the operator in this regard appear to have focused on trying to predict, from the size adjustment of the paper tray, the size of the copy sheet in the other direction, it being understood that the paper tray is adjusted for a copy sheet size along one dimension (i.e. the X dimension), while the copy sheets are moved through the machine in a direction normal thereto (i.e. along an axis parallel to the copy sheet Y dimension). Thus, the theory behind this is to predict the copy sheet Y-dimension from the X-dimension. In that type of arrangement, an interconnection such as levers is established between the paper tray and the machine component to be adjusted, for example the duplex tray, such that when the paper tray is adjusted for the size copy sheets being loaded, a predetermined adjustement is made to the duplex tray at the same time. While the foregoing procedure can be effective, it may also be cumbersome, particularly where adjustments to more than one machine component are required, or in the case where multiple paper trays each capable of holding a different size copy sheet are provided. Additionally, this procedure places its reliance on there being a constant and established dimensional relationship between the copy sheet length and width dimensions as for example in the U.S. where an $11\frac{1}{2}$ inch long copy sheet can be reliably assumed to be $8\frac{1}{2}$ inches wide. Unfortunately, the relationship between copy sheet dimensions may vary from country to country, and may even change within the country in accordance with local conditions, usage, and customs.

The present invention seeks to obviate the foregoing problems and reduce the burden on the machine operator or user by providing a reproduction machine having a paper path along which copy sheets being processed are moved, at least one copy processing station in or insertable into the paper path, the copy processing station including a receptacle for temporarily receiving the copy sheets being processed which is adjustable to the size of the copy sheets being processed; transport means for moving the copy sheets along the paper path during processing; copy sheet size determining means astride the paper path to determine the size of at least the first copy sheet being processed as the copy sheet moves along the paper path; and control means for adjusting the size of the copy processing station receptacle in accordance with the size determined.

The invention further relates to the method of producing copies wherein images are electrostatically created, developed and transferred to copy sheets moving along a predetermined path, with at least one processing station whereat the copy sheets are temporarily received during processing, comprising the steps of: determining the size of the first one of the copy sheets to be processed as the first copy sheet moves along the path; and adjusting the operating dimension of the processing station in accordance with the copy sheet size determined.

IN THE DRAWINGS

FIG. 3 is a schematic view illustrating the control subdivisions and communication channel for the reproduction machine shown in FIG. 1;

FIG. 4 is a schematic view illustrating the distribution of timing signals to the various control subdivisions for the machine shown in FIG. 1;

FIG. 5 is a view showing details of the information byte accompanying each copy and bearing instructions for processing the copy;

Figure 12A:
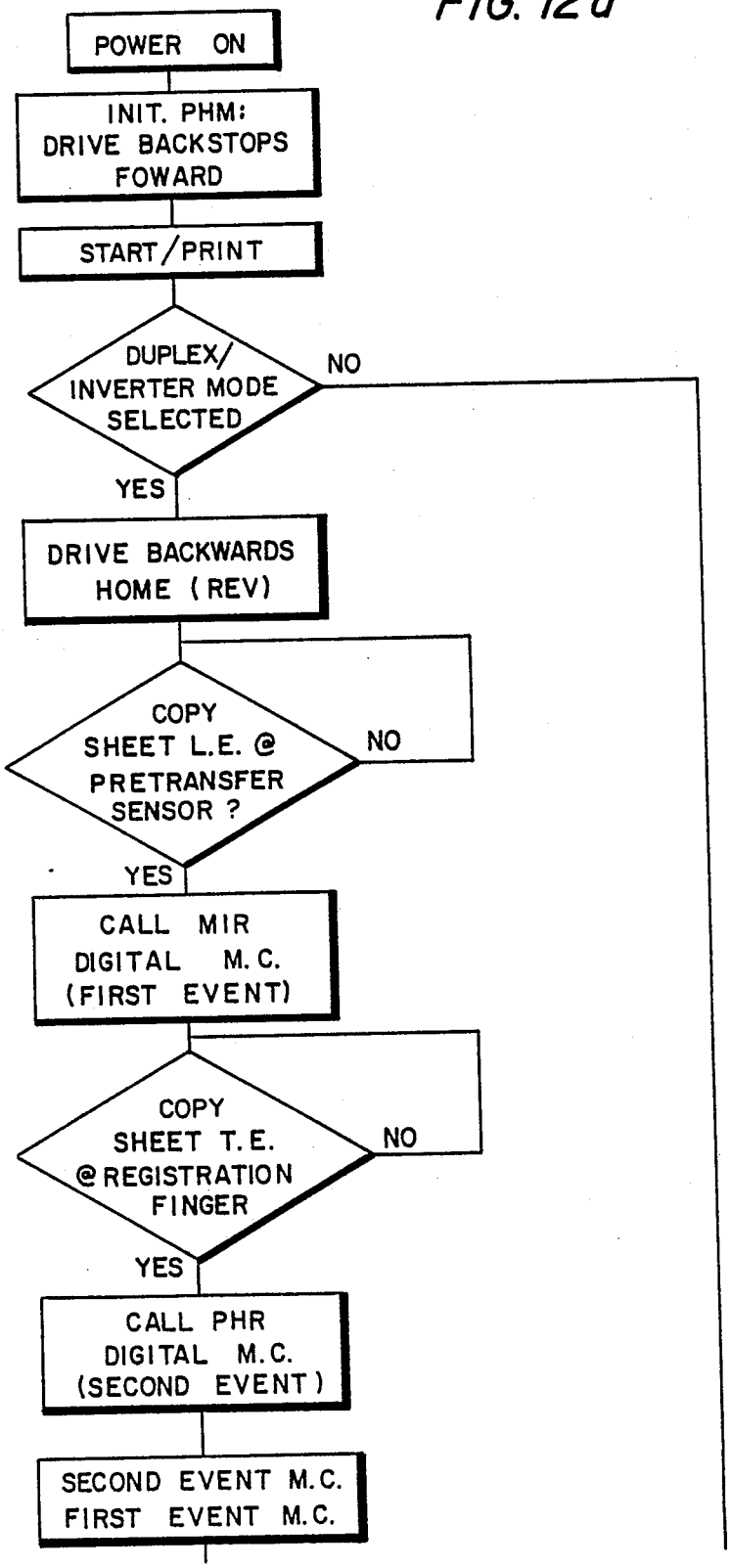
Figure 12B:
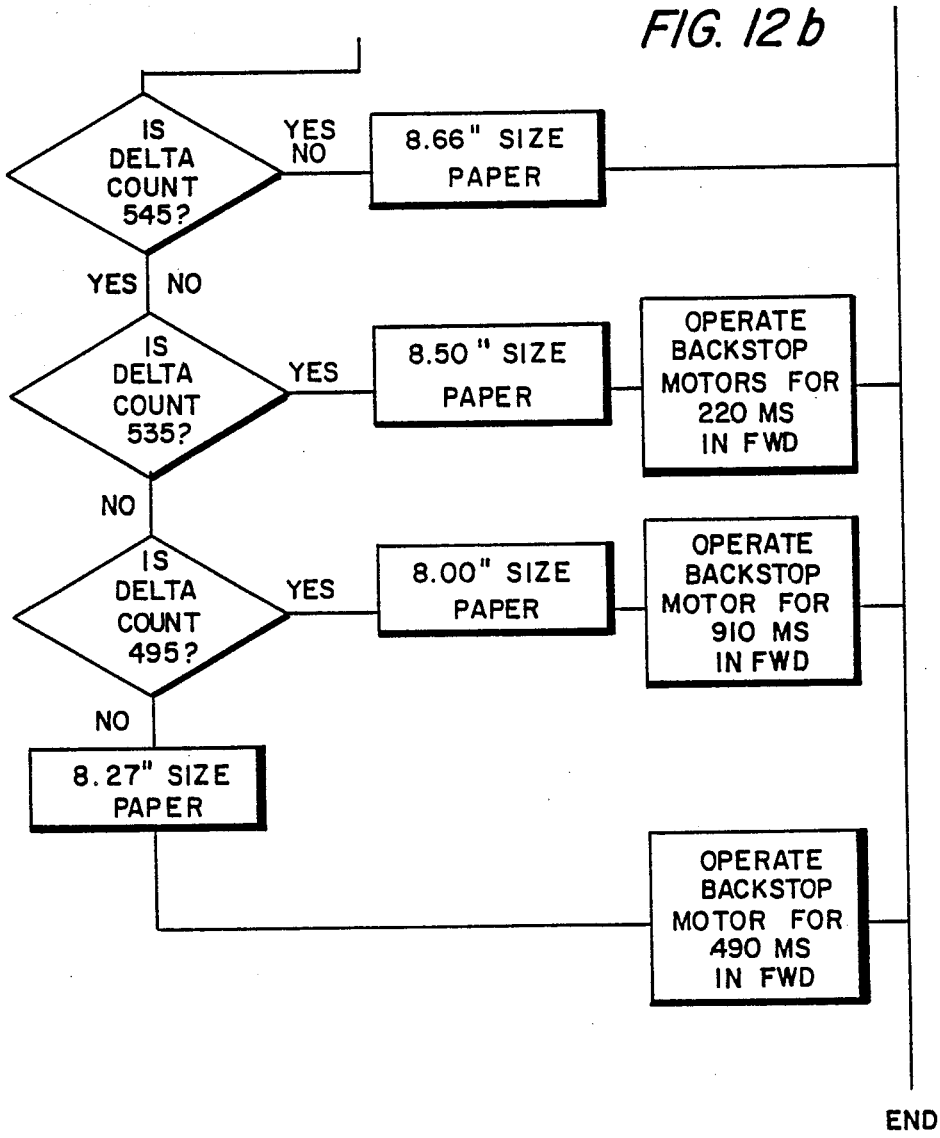
Figure 13:
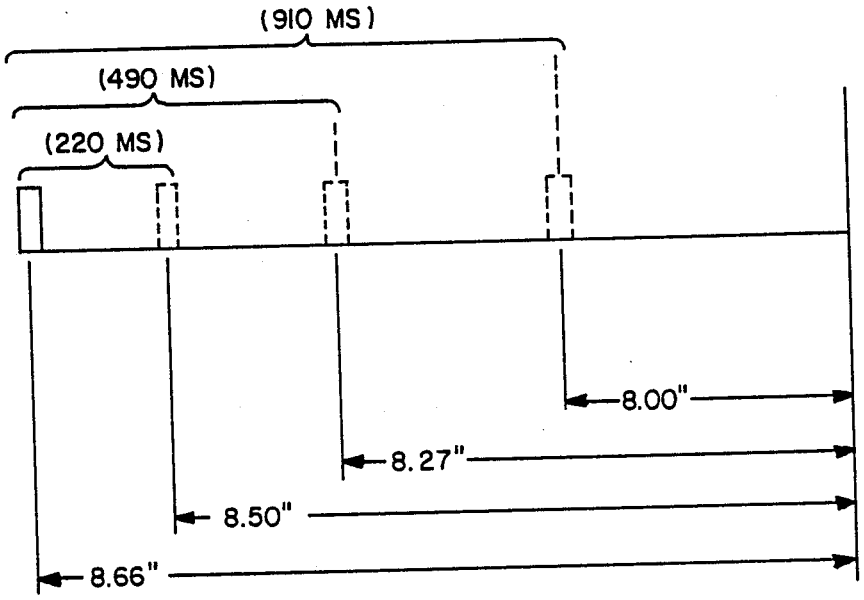

FIGS. 12*a* and 12*b* together comprise is a flow chart showing the duplex and inverter backstop adjusting procedure including determining the size of the copy sheet currently in use;

FIG. 13 is a graphical representation illustrating adjustment of the duplex and inverter backstops to operating position;

FIG. 14 is a view of TABLE I in which examples of counts for controlling the positioning of duplex and inverter backstops for different copy sheet sizes are given;

FIG. 15 is a view of TABLE II in which the initialization cycle for the machine paper handling module is provided;

FIG. 16 is a view of TABLE III in which the cycle up procedure for the machine paper handling module is provided;

FIG. 17A is a view of part of TABLE IV in which the routine for adjusting the duplex and inverter backstops is provided; and FIG. 17B is a view of the remainder of TABLE IV in which the routine for adjusting the duplex and inverter backstops is provided.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 1:
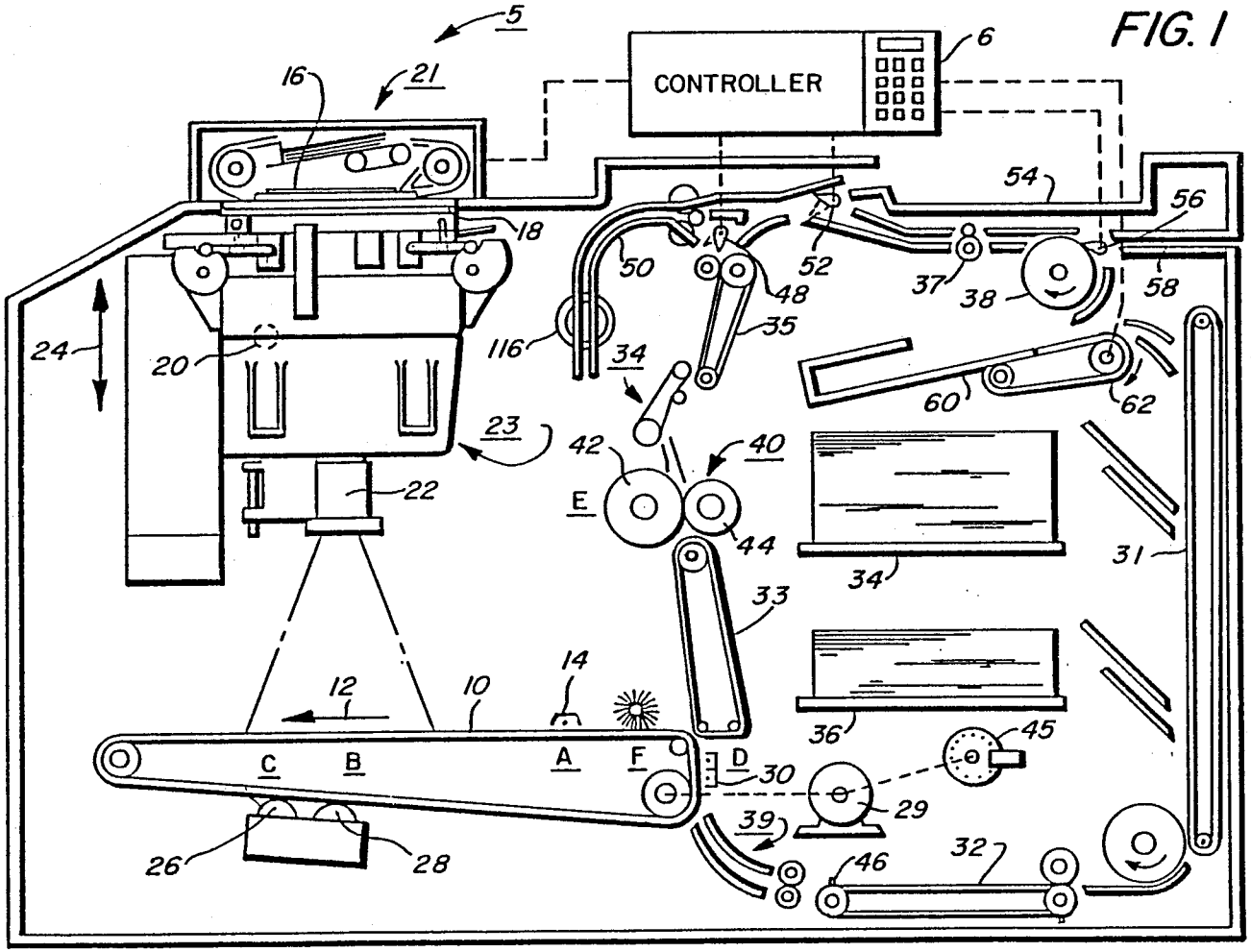
FIG. 1 is a plan view of a reproduction machine incorporating the copy sheet processing system of the present invention.

For a general understanding of the features of the present invention, reference is had to the drawings. In the drawings, like reference numerals have been used throughout to designate identical elements. FIG. 1 schematically depicts the various components of an illustrative electrophotographic printing machine 5 incorporating the copy processing and jam monitoring system of the present invention therein. It will become evident from the following discussion that the invention is equally well suited for use in a wide variety of printing machines and is not necessarily limited in its application to the particular embodiment shown herein.

Inasmuch as the art of electrophotographic printing is well known, the various processing stations employed in the printing machine 5 will be shown hereinafter schematically and their operation described briefly with reference thereto.

Figure 2:
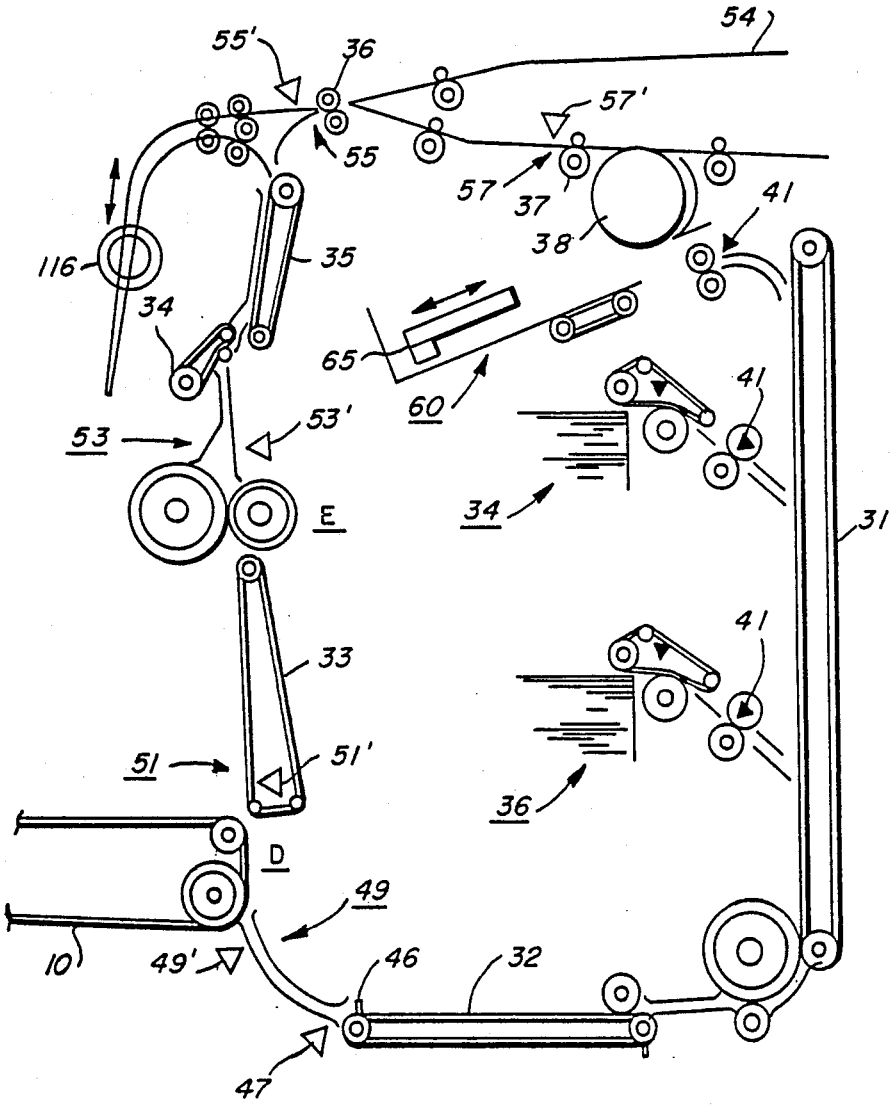
FIG. 2 is a schematic illustration showing details of the reproduction machine paper path and jam detection stations.

As shown in FIGS. 1 and 2, the illustrative electrophotographic printing machine 5 employs a belt 10 having a photoconductive surface thereon. Preferably, the photoconductive surface is made from a selenium alloy. Belt 10 is driven by main drive motor 29 and moves in the direction of arrow 12 to advance successive portions of the photoconductive surface through the various processing stations disposed about the path of movement thereof.

Initially, a portion of the photoconductive surface passes through charging station A. At charging station A, a corona generating device, indicated generally by the reference numeral 14, charges the photoconductive surface to a relatively high substantially uniform potential.

Next, the charged portion of the photoconductive surface is advanced through imaging station B. At imaging station B, a document handling unit, indicated generally by the reference numeral 21, positions original documents 16 facedown over exposure system 23. The exposure system, indicated generally by reference numeral 23 includes lamp 20 which illuminates the document 16 positioned on transparent platen 18. The light rays reflected from document 16 are transmitted through lens 22. Lens 22 focuses the light image of original document 16 onto the charged portion of the photoconductive surface of belt 10 to selectively dissipate the charge thereof. This records an electrostatic latent image on the photoconductive surface which corresponds to the informational areas contained within the original document. Thereafter, belt 10 advances the electrostatic latent image recorded on the photoconductive surface to development station C. Platen 18 is mounted movably and arranged to move in the direction of arrows 24 to adjust the magnification of the original document being reproduced. Lens 22 moves in synchronism therewith so as to focus the light image of original document 16 onto the charged portion of the photoconductive surface of belt 10. While a light/lens type exposure system is illustrated herein, other exposure systems such as scanning laser may be envisioned.

Document handling unit 21 sequentially feeds documents from a stack of documents placed by the operator in a normal forward collated order in a document stacking and holding tray. The documents are fed from the holding tray, in seriatim, to platen 18. The document handling unit recirculates documents back to the stack supported on the tray. Preferably, the document handling unit is adapted to serially sequentially feed the documents, which may be of various sizes and weights of paper or plastic containing information to be copied. The size of the original document disposed in the holding tray and the size of the copy sheet are measured. Preferably, magnification of the imaging system is adjusted to insure that the indicia or information contained on the original document is reproduced within the space of the copy sheet.

While a document handling unit has been described, one skilled in the art will appreciate that the original document may be manually placed on the platen rather than by the document handling unit. This is required for a printing machine which does not include a document handling unit.

A plurality of sheet transports comprising a vertical transport 31, a registration transport 32, prefuser transport 33, decurier 34, post fuser transport 35, output transport 36, bypass transport 37, and inverter roll 38, cooperate with suitable sheet guides 39 to form a paper path through which the copy sheets being processed pass from either main paper supply tray 34, or auxiliary paper supply tray 36, or duplex paper supply tray 60 through the machine 5 to either top tray 54 or discharge path 58. Transports 31, 32, 33, 34, 35, 36, 37, 38 are suitably driven by main drive motor 29. Suitable sheet sensors designated here by the numeral 41, are provided at the output of each paper tray 34, 36 and duplex tray 60 to detect feeding of a sheet therefrom.

With continued reference to FIG. 1, at development station C, a pair of magnetic brush developer rollers, indicated generally by the reference numerals 26 and 28, advance a developer material into contact with the electrostatic latent image. The latent image attracts toner particles from the carrier granules of the developer material to form a toner powder image on the photoconductive surface of belt 10.

After the electrostatic latent image recorded on the photoconductive surface of belt 10 is developed, belt 10 advances the toner powder image to transfer station D.

At transfer station D, a copy sheet is moved into transfer relation with the toner powder image. Transfer station D includes a corona generating device 30 which sprays ions onto the backside of the copy sheet. This attracts the toner powder image from the photoconductive surface of belt 10 to the sheet. After transfer, prefuser transport 93 advances the sheet to fusing station E.

Fusing station E includes a fuser assembly, indicated generally by the reference numeral 40, which permanently affixes the transferred powder image to the copy sheet. Preferably, fuser assembly 40 includes a heated fuser roller 42 and backup roller 44. The sheet passes between fuser roller 42 and backup roller 44 with the powder image contacting fuser roller 42. In this manner, the powder image is permanently affixed to the sheet.

After fusing, decurler 34 and post fuser transport 35 carry the sheets to inverter gate 48 which functions as an inverter selector. When energized or pulled, gate 48 directs the copy sheets into a sheet inverter 50. When inoperative, gate 48 bypasses sheet inverter 50 and the sheets are fed directly to bypass gate 52. Thus, copy sheets which bypass inverter 50 turn a 90° corner in the paper path before reaching gate 52. Bypass gate 52 directs the sheets into top tray 54 so that the imaged side which has been transferred and fused is faceup. If inverter 50 is selected, the opposite is true, i.e. the last printed face is facedown. Bypass gate 52 normally directs the sheet into top tray 54 or, when energized, to bypass transport 37 which carries the sheet to duplex gate 56. Gate 56 either directs the sheets without inversion to the discharge path 58 or, when energized, to duplex inverter roll 38. Inverter roll 38 inverts and directs the sheets to be duplexed into duplex tray 60. Duplex tray 60 provides intermediate or buffer storage for those sheets which have been printed on one side and on which an image will be subsequently printed on the side opposed thereto, i.e. the copy sheets being duplexed. Due to the sheet inverting action of inverter roll 38, the buffer set of sheets are stacked in duplex tray 60 facedown in the order in which the sheets have been copied.

In order to complete duplex copying, the previously simplexed sheets in tray 60 are fed seriatim by bottom feeder 62 back via vertical transport 31 and registration transport 32 to transfer station D for transfer of the toner powder image to the opposed side of the sheet. Inasmuch as the bottommost sheet is fed from duplex tray 60, the proper or clean side of the copy sheet is positioned in contact with belt 10 at transfer station D so that the toner powder image thereon is transferred thereto. The duplex sheets are then fed through the same path as the previously simplexed sheets to the selected output for subsequent removal by the printing machine operator.

Referring particularly to FIG. 3, reproduction machine 5 is segregated into a series of independent modules (termed remotes herein), and identified as finishing output remote (FOR) 9, paper handling remote (PHR) 11, marking and imaging remote (MIR) 13, xerographic remote (XER) 15, recirculating document handler remote (RDHR) 17, and central processing master (CPM) 19. FOR 9, PHR 11, MIR 13, XER 15, RDHR 17, and CPM 19 are communicated with one another by means of a shared communication line (SCL) 25 through which controlled instructions and synchronizing clock pulse signals from and to the machine remotes pass.

Referring particularly to FIGS. 1 and 4, a suitable machine clock pulse generator 45, which is drivingly coupled to the output shaft of main drive motor 29, generates a succession of clock pulses whenever drive motor 29 is energized. The clock pulse output of clock generator 45 serves to provide timing signals for various components of reproduction machine 5 and for operating a global counter 43. As will be understood, to enhance copy throughput, several copy sheets may be in process at various locations along the paper path at any one time. To accommodate this and permit individual copies to be tracked and processed in the particular manner desired, timing control over the copy processing functions is divided into pitches, each pitch being further subdivided into a number of machine clock pulses. For example, the paper path may be separated into eleven pitches with each pitch being composed of approximately 850 machine clock pulses.

Pitch reset signals, which serve in effect to determine the length of the pitch and the number of machine clock pulses within the pitch, are derived from copy sheet registration finger 46 on registration transport 32. For this purpose, a sensor such as switch 47 is disposed in the path of movement of copy sheet registration fingers 46 such that on each cycle of finger 46 past switch 47, switch 47 outputs a reset signal. The output of machine clock pulses by generator 45 are input through CPM 19 to PHR 11 while the pitch reset signals generated by switch 47 are input directly to PHR 11.

Referring particularly to FIG. 2, to monitor and control movement and processing of the copy sheets moving along the paper path, a series of sensors which may for example comprise switches, are disposed at predetermined jam detection stations along the paper path. More specifically, a pretransfer jam detection station 49 is provided upstream of transfer station D having sheet sensor 49', a pre-fuser jam detection station 51 is provided upstream of fusing station E having sheet sensor 51', a post-fuser jam detection station 53 is provided on the downstream side of fusing station E having sheet sensor 53', an output transport jam detection station 55 is provided at the inlet to output transport 36 having sheet sensor 55', and a bypass jam detection station 57 is provided in the bypass transport 37 upstream of duplex inverter roll 38 having sheet sensor 57'.

Referring particularly to FIGS. 1, 3 and 5 of the drawings, to enable the user or operator of reproduction machine 5 to control the machine and program the copy run desired, a suitable operator control panel 6 is provided at some convenient location on machine 5. CPM 19 includes a scheduler 50 for scheduling processing of each copy, the copy run instructions programmed through control panel 6 being input to scheduler 59. As will be understood by those skilled in the art, there is also provided a suitable memory section, exemplified herein by Main Memory Board (MMB) 7 (shown in FIG. 3). MMB 7 normally includes both Read Only Memory (ROM) and Random Access Memory (RAM), and non-volatile memory or NVM 61 wherein data representing the particular machine configuration parameters (i.e. document handler type) and operating parameters (i.e. exposure timing) is stored. Additionally, CPM 19 includes on-board memory such as RAM memory 63. Scheduler 59 responds to the copy run information input by the operator through control panel 6 and the machine configuration and operating parameters input from NVM 61 to generate a copy information byte 64 (COPY @INFO) for each copy to be made.

In the exemplary arrangement shown, copy information byte 64 contains data identifying the copy sheet source (i.e. tray 34, 36, or 60), the copy destination (i.e. top tray 54, FOR 9, or duplex tray 60), whether the copy is to be inverted or not (i.e. by inverter 50), whether the copy represents the end of the set (i.e. the last copy of a batch), if the sheet is a clearing or purge sheet (normally as a result of a paper jam), and image information related to the particular copy being made (i.e. feed or not feed a sheet). The copy information byte is entered in RAM 63 and held in a suitable memory location or variable, the latter being defined herein as a location in memory where information is stored. The copy information byte 64 is moved from memory variable to memory variable in synchronism with movement of the copy sheet along the paper path from jam detection station to jam detection station (i.e. from pretransfer jam detection station 49 to prefuser jam detection station 51, from prefuser jam detection station 51 to post fuser jam detection station 53, etc.). In effect, jam detection stations 49, 51, 53, 55 and 57 serve to pass the copy information byte 64 from memory variable to memory variable. At each memory variable, corresponding to a jam detection station, the copy information byte is read to provide operating instructions for the copier components up to the next jam detection station.

Referring particularly to FIGS. 6–8 and 14 of the drawings, the duplex tray 60 includes an adjustable copy sheet scuffer or duplex backstop 65 for engaging the leading edge of the copy sheets to be duplexed as the copy sheets are fed into duplex tray 60 by the inverter transport 38 when reproduction machine 5 is programmed to produce duplex or two sided copies. Duplex backstop 65 serves to brake copy sheet movement and locate and settle the copy sheets into the duplex tray 60 in proper disposition for proper refeeding by duplex sheet feeder 62.

Duplex backstop 65 utilizes a pair of rotatable backstop rollers 67, 68 (seen in FIGS. 7 and 8) depending from a movable carriage assembly 69 mounted above the rear side of the tray 60 and at an angle perpendicular to the bottom plate 70 of the tray which supports copy sheets fed into and out of the tray. The backstop rollers 67, 68 are movable toward and away from the bottom feeder 62 as will be described hereinafter in order to position the leading edges of copy sheets in the tray so that they may be properly fed out of the tray by the feeder 62 during a duplex operation. This movement of the backstop rollers is devised to be in accordance with the various types of sheet sizes that may be usable in the machine 5 especially in view of the numerous types of sheets which may be utilized as copy sheets in reproduction runs.

The adjustable range of movement for the rollers 67, 68 is sufficient to permit the accommodation of various copy sheet sizes, examples of which are shown in Table I. In the embodiment shown, the range of movement of backstop 65 is at least sufficient to accommodate sheet sizes from 8.00" to 8.66". It will be understood that other sizes and ranges of paper widths and corresponding range of movements placed upon the rollers 67, 68 may be provided.

Figure 6:
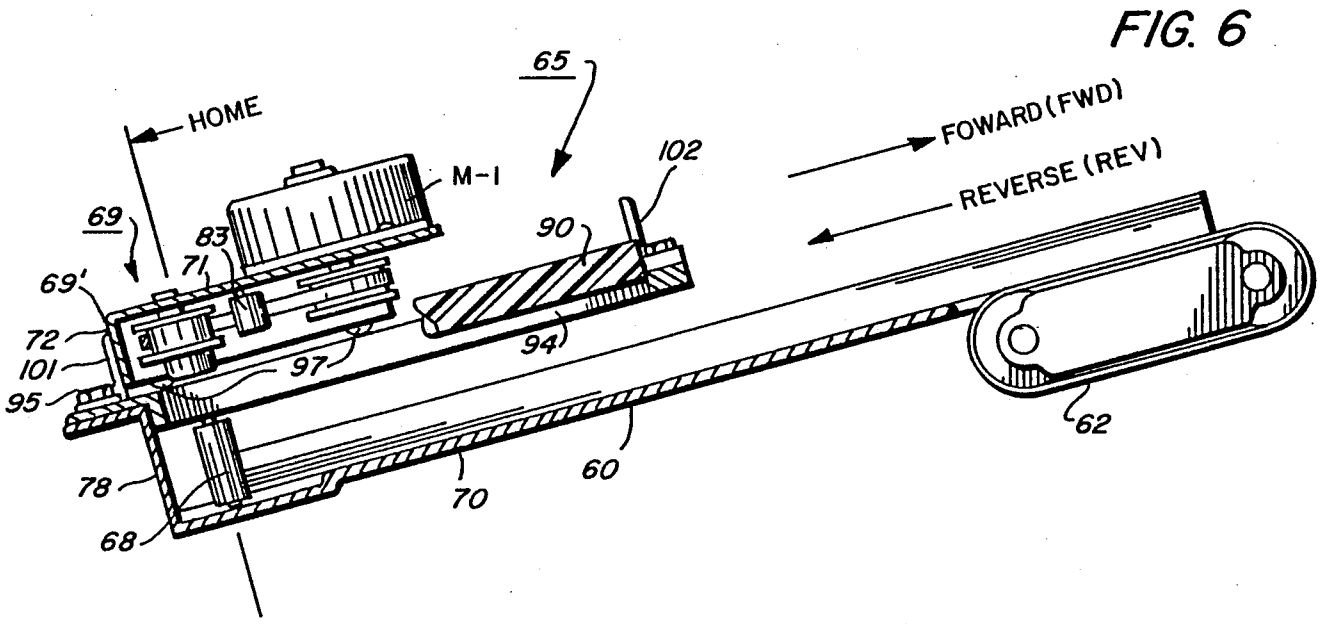
FIG. 6 is a fragmentary elevational view of the duplex tray shown in the machine of FIG. 1 incorporating the present invention.

As shown in FIG. 6, a plurality of copy sheets are positioned in the tray 60 with their rear edges against the backstop rollers 67, 68 and with their leading edges adjacent the bottom feeder 62 positioned to be fed from the tray. In entering the tray, what was once the leading edge of the sheets are now the trailing edges and what was the trailing edges are now the leading edges. The carriage assembly 69 upon which the depending backstop rollers 67, 68 are supported for rotation comprises a housing 69' having an upper plate 71, a rear plate 72, and side plates 73, 74 and a bottom plate 75.

Figure 8:
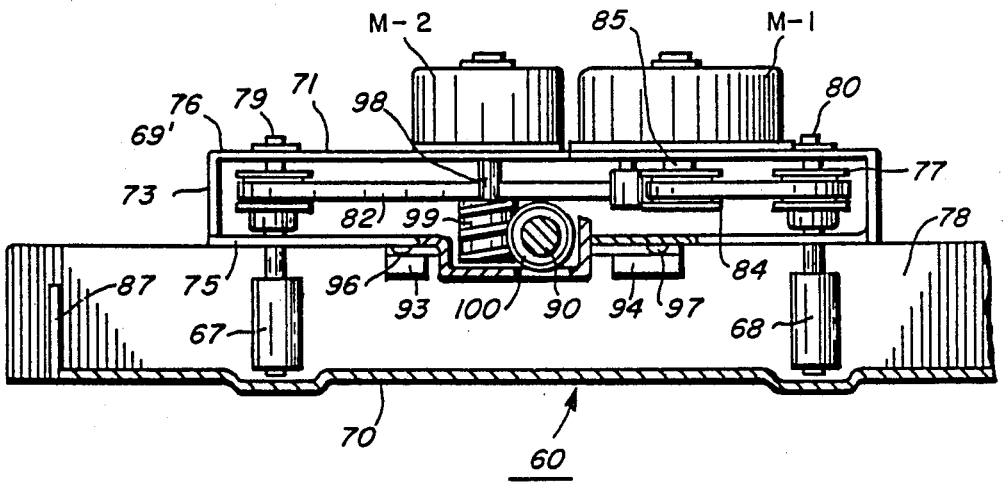
FIG. 8 is a fragmentary view showing the copy sheet scuffer assembly in detail.

Within the housing 69' of the assembly 69, a pair of pulleys 76, 77 are mounted for rotation between the plates 71, 75, and have their axis of rotation equally spaced from the rear wall 78 of the duplex tray 60. The pulleys 77, 78, which are secured to the shafts 79, 80, respectively and are mounted for rotation through the plates 71, 75, are prevented from axial movement relative thereto by suitable lock washers. As shown in FIG. 8, the backstop roller 67 is mounted on the shaft 79 while the backstop roller 68 is mounted on the lower end of the shaft 80. With this arrangement, the axis of rotation of the rollers 67, 68 are parallel to each other and to the rear side 78 of the tray 60.

Figure 7:
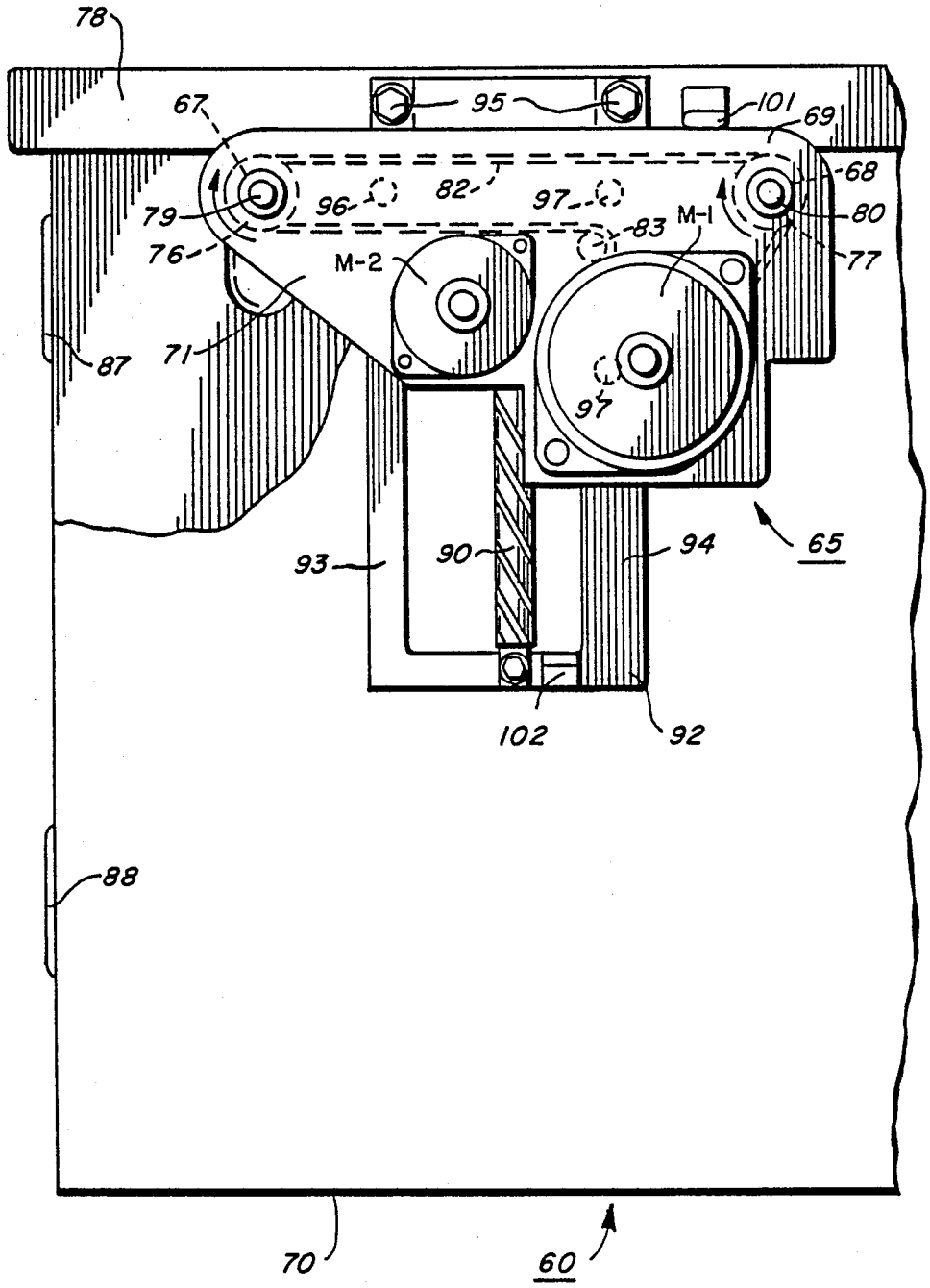
FIG. 7 is a fragmentary plan view of the duplex tray.

A timing belt 82 is entrained around the pulleys 76, 78, this belt also extending around an idler roller 83 mounted for rotation within the housing 69' and a drive pulley 84 secured to a shaft 85 for a reversible motor M-1 mounted upon the upper side of the top plate 71. As shown in FIG. 7, the belt 82 is arranged to impart rotation to the rollers 76, 78 in the same direction clockwise as shown in the drawing thereby forcing or scuffing each sheet of paper entering the tray against side registration stops 87, 88 mounted on the side edge of the bottom plate 70 for the tray 60. By this arrangement duplex, backstop 65 is adapted to register sheets in the forward direction and also to produce side registration so that copy sheets leaving the duplex tray for the duplex operation are properly corner registered as the sheets leave the tray.

Duplex backstop housing 69' is movable from a home position (HOME) toward (i.e. FORWARD) and away (i.e. REVERSE) from the feeder 62 in order to adjust the positioning of the backstop rollers 67, 68 relative to the feeder in accommodation of the copy sheet size being processed by means of a helical screw 90 mounted in fixed position with its axis in alignment with the direction of adjustable movement of the backstop rollers and along which the carriage assembly 69 is moved in forward or reverse direction relative to the screw 90. The screw 90 is mounted at one end to a rectangular shaped frame member 92 having first and second longitudinal rails 93, 94 spaced parallel from each other and which are secured to the rear wall 78 of the duplex tray 60 by suitable screws 95. The scuffer housing 69 is arranged above the rails 93, 94 and are provided on the lower surface of the plate 75 with a dimple 96 depending therefrom and in engagement with the rail 93 and a pair of dimples 97 engageable with the second rail 94. The carriage assembly 69 is adapted to be supported by and to slide upon the rails 93, 94 by virtue of the dimples 96, 97.

A reversible positioning motor M-2 is mounted on a top surface of the top plate 71 for the carriage assembly 69 adjacent the motor M-1. The shaft 98 for the motor M-2 has a worm gear 99 secured at the end thereof positioned within the housing 69 and made drivingly cooperable with a nut 100 through which the fixed screw 90 is threaded. Upon energization of the motor M-2, the worm gear 99 produces rotation of the nut 100 and consequent movement of the nut, axially of the fixed screw 90. In this manner, the entire carriage 69 will be moved accordingly. The motor M-2 is of the reversible type so that energization may selectively effect movement of the carriage assembly 69 in either the FORWARD or REVERSE direction, that is toward and away from the bottom feeder 62. Stops 101, 102, which are preferably adjustable, are provided to limit maximum movement of the carriage housing in the REVERSE and FORWARD directions respectively, stop 101 additionally serving to define the HOME position for duplex backstop 65.

Figure 9:
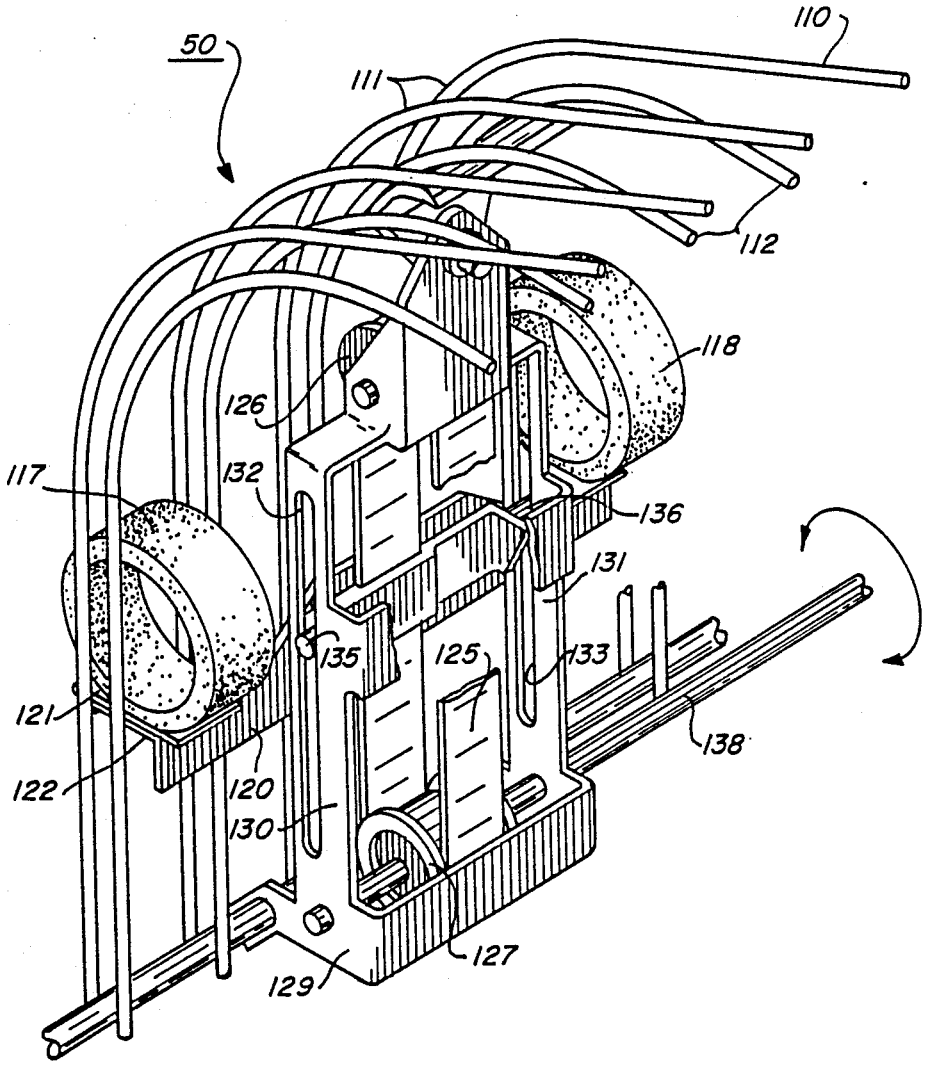
FIG. 9 is an isometric view of the inverter/reverser shown in the machine of FIG. 1 incorporating the present invention.
Figure 10:
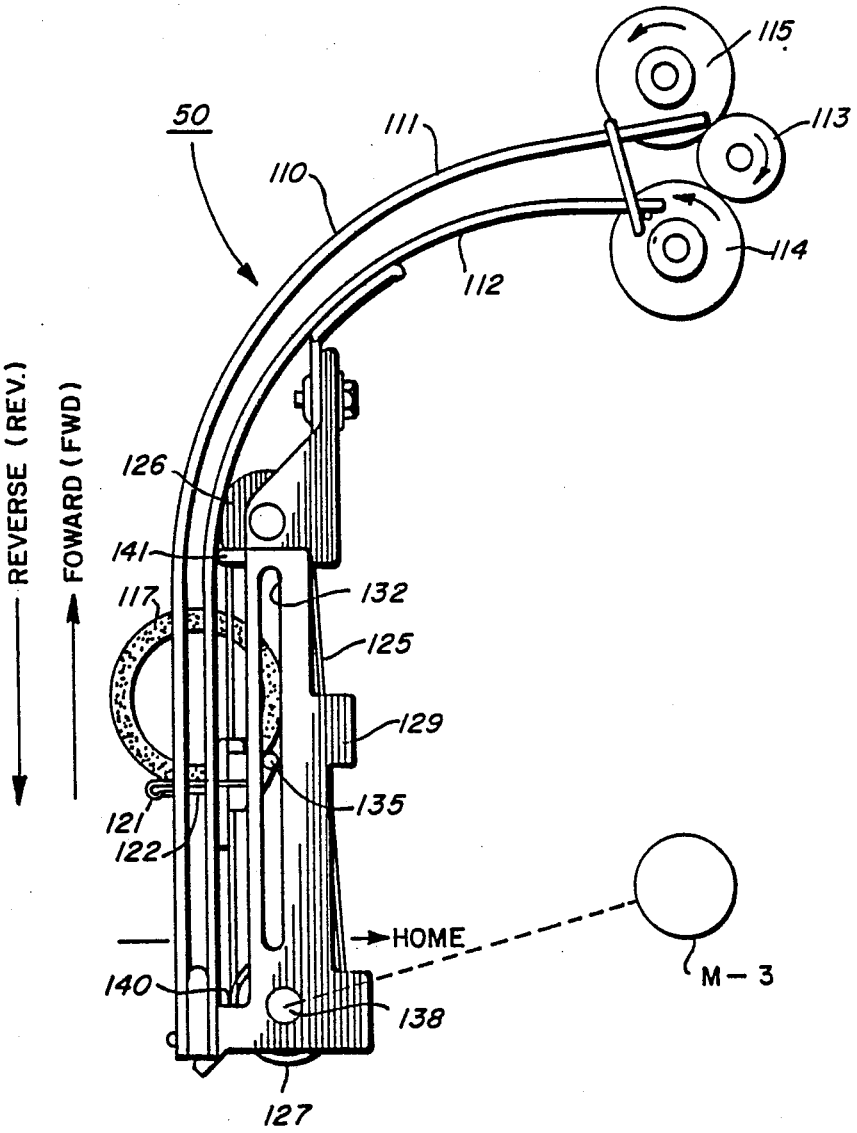
FIG. 10 is an elevational view of the inverter/reverser.

Referring particularly to FIGS. 9 and 10 of the drawings, the inverter/reverser 50 includes a chute 110 comprising paper guides 111, 112 made from wire strands spaced apart in parallel and extending in width to a dimension approximately equal to the length of the sheet of paper. The wire guides 111, 112 are spaced one from another a sufficient distance to permit sheets to be driven into and out of the chute 110 without constraints. As shown in FIG. 9, the paper guides 111, 112 are curved at their upper ends, and their orientation, starting from a generally horizontal entry position for sheets entering the chute, is such as to terminate in a vertical plane.

The chute 110 includes at its upper entry end the conventional tri-roller transport means for inverters comprising a driven central roller 113 and two idler rollers 114, 115 on either side of the roller 113 to be driven thereby. Sheets enter the chute 110 with a side edge or width orientation being conveyed therein by the roller pair 113, 114 and being driven out of the chute by the roller pair 113, 115.

Spaced between the wire strands comprising the paper guides 111, 112, as shown in FIG. 9, is a backstop 116 comprised of a pair of resilient stop members 117, 118. The members 117, 118 extend within the space between the guides 111, 112 and are arranged to intercept the leading edge of the copy sheets entering the chute 110 as the leading edge is being driven downwardly by the roller pair 113, 114. The members 117, 118 are spaced apart relative to one another a distance shorter than the smallest sheet that the inverter 50 is conditioned to handle so that at all times every sheet entering and leaving the inverter contacts both of the members 117, 118. The members 117, 118 are formed as ring-shaped from flexible polyurethane foam having a light spring rate so that the members do not damage light paper while being compliant enough to accept a large mass range. Recovery of the foam, ring-shaped members to its circular shape is used to drive a sheet into the nip of the roller pair 113, 115 after the now leading edge of the sheet is carried to the nip by the roller 113.

Adjacent the lower end of the chute 110 is a yoke element 120 which is positioned horizontally adjacent the wire guide 112 and extends across the width of the chute 110 below the members 117, 118. Each of the members 117, 118 is fastened to one end of the yoke element 120 by means of spring snaps 121 which secure the member to a bent tab 122 formed from the material of the yoke 120 and extending through both of the wire guides 111, 112. The yoke element 120 is secured to a timing belt 125 which is entrained around an upper driven roller 126 and a lower drive roller 127. The belt 125 is oriented vertically and has a working run of approximately 5 inches to which the element 120 is attached in order to provide a range of movement of the members 117, 118 for approximately 3½ inches.

As will be understood, the adjustable range of movement for the inverter backstop 116 is at least sufficient to accommodate the range of sheet sizes shown in Table I. It will be understood that other sizes and ranges of paper widths and corresponding range of movements placed upon the stop members 117, 118 may be provided.

The yoke element 120 is arranged to be moved vertically in either direction by means of the timing belt 125. The rollers 126, 127 are arranged for rotation in a frame 129 secured to the frame structure of the machine 5. The frame 129 is generally rectangular in configuration and includes two side rails 130, 131 which are vertically oriented and positioned parallel to the lower straight portions of the wire guides 111, 112. Each of the side rails 130, 131 are formed with elongated slots 132, 133 respectively. Slideable within each of these slots is a guide pin 135, 136 respectively secured to the yoke element 120 and which serve to guide the element 120 during its vertical movement in either direction.

The lower drive roller 127 is secured to a shaft 138 suitably journaled in the rail members 130, 131 of the frame 129. The shaft 130 is connected to a reversible motor M-3 for selectively driving the stop members 117, 118 to any vertically oriented position within the chute 110.

As previously stated, the present invention provides automatic adjustment of the inverter backstop 116 for sheets in the inverter 50 in accordance with width sizes of copy sheets placed in the machine 5. Such adjustment is made by energizing the positioning motor M-3 in either the forward (FWD) or Reverse (REV) direction to effect movement of the yoke element 120 with stop members 117, 118. Fixed stops 140, 141 limit maximum movement of stop members 117, 118, the lower stop 117 further serving to define a home (HOME) position, the purpose and use of which will appear more fully hereinbelow.

As will appear, the present invention enables automatic adjustment of both duplex backstop 65 and inverter backstop 116 in the event either duplex or inverter copy modes are selected by the machine operator. For this purpose, a HOME position is established for both duplex and inverter backstops from which adjustment of the backstop position takes place. Preferably, the HOME position represents one sheet size (i.e. 8.66″). Where an adjustment of the duplex and inverter backstops 65, 116 is called for, the backstops are automatically moved from the HOME position to the correct position, the degree of backstop adjustment being determined by the size of the copy sheets being processed which in turn is determined by measuring the first copy sheet being processed as the sheet traverses along the paper path.

When reproduction machine 5 is first turned on, both the duplex backstop 65 and inverter backstop 116 are moved away from the HOME position and are at start up of machine 5, in an unknown position. Thereafter, when either duplex or inverter copy modes are selected, the drive motors M-2, M-3 for the duplex and inverter backstops 65, 116 respectively are first energized for a preset interval to drive the backstops from the unknown position to the HOME position and a determination of the size of the first copy sheet (representing the copy sheets to be processed) is made as the first copy sheet passes along the paper path. With the size of the copy sheet known, the duplex and inverter backstops 65, 116 are thereafter adjusted to the proper position.

Referring to FIGS. 11–13, 15, 16, 17A and 17B, at first turn on or start up of reproduction machine 5, (POWER ON), which is normally through actuation of a power on switch or button (not shown) on control panel 6 by the operator, reproduction machine 5 enters an initialization stage during which the various components that comprise remotes FOR 9, PHR 11, MIR 13, XER 15, RDHR 17, and CPM 19, are initialized (i.e. INITIALIZE PAPER HANDLING MODULE, Table II) and readied for operation. For example, during this period fuser section 40 is brought up to operating temperatures.

Referring particularly to Table II, during initialization of PHM 11, duplex and inverter backstop motors M-2 and M-3 are energized for a predetermined period (i.e. 2 seconds) in the forward direction (FWD) to drive duplex and inverter backstops 65, 116 respectively, in the direction away from the HOME position, it being understood that at machine start up, the position of backstops 65, 116 is unknown. If backstops 65, 116 happen to be in the HOME position at start up, a subsequent attempt to move the backstops further toward HOME position could result in the drive motors M-2 and M-3 inadvertently reversing and instead moving the backstops away rather than toward HOME postion. Initially moving the backstops away from the HOME position assures that the backstops are not in the HOME position at machine start up.

Following completion of the initialization process, reproduction machine 5 is ready for operation, it being understood that the position of duplex and inverter backstops 65, 116 respectively is then unknown. Thereafter each time reproduction machine 5 is actuated to perform a copy run, a cycleup procedure (i.e. PHM Cycle-Up, Table III), is entered wherein the various remote sections such as PHM 11 are brought into operation as required by the copy run program.

When either duplex (DUPLEX SELECTED) or inverter (QUANTITY @SELECTED =1: this refers to copy information byte 69) modes are programmed by the operator, the routine for adjusting backstops 65, 116 (ADJUST BACKSTOP), (Table IV) is entered. In this routine and referring particularly to Table IV, the duplex and inverter backstops 65, 116 respectively, are brought from their unknown position to the HOME position by energizing duplex and inverter backstop drive motors M-2, M-3 in the reverse direction (REV) for a preset interval (HOME BACKSTOP; DUP REV←ON; WAIT 1010 MS/60 HERZ). Following homing of the backstops 65, 116, the size of the copy sheets being processed is then determined by dynamically measuring the dimension of the first copy sheet (in the direction of copy sheet movement) as the sheet moves along the copy path toward pretransfer jam station 49.

Figure 11:
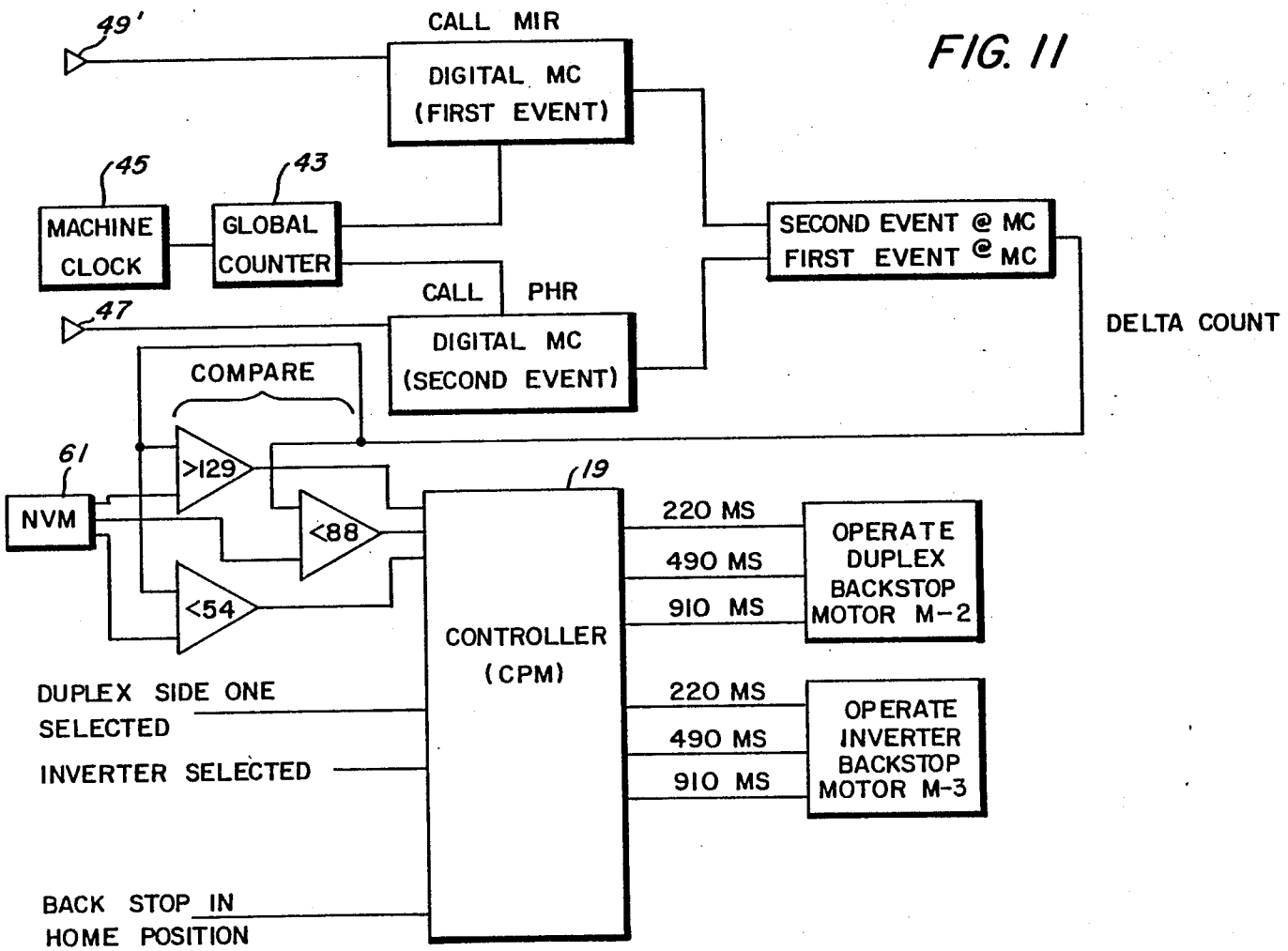
FIG. 11 is a block diagram illustrating the component parts of the duplex and inverter backstop controls.

Referring particularly to FIGS. 2, 11 and 12, as the copy sheet approaches pretransfer jam station 49, the copy sheet leading edge is sensed by sensor 49'. The signal from sensor 49' causes the count on global counter 43 to be read into RAM memory 63 (CALL MIR DIGITAL MC (IO-VAL (PRE #XER, PAPER)) RETURNS MSB, LSB, FIRST EVENT). Thereafter, as the copy sheet is registered by registration finger 46, a signal from switch 47 in response to movement of the registration finger 46 past switch 47 causes the new count on global counter 43 to be read into RAM memory section 63 (CALL PHR-DIGITAL MC (IO-VAL (REG #FNGR, TRUE)) RETURNS MSB, LSB, SECOND EVENT). The leading edge and registration counts are subtracted from one another (DELTA@MACH CLK←(SECOND EVENT@MC-FIRST EVENT@MC))and the resulting difference (DELTA@MACH@CLK), which is representative of the copy sheet size (referred to herein as delta count), is obtained and entered in RAM memory section 63.

The delta count obtained (i.e. DELTA@-MACH@CLK) is then compared with predetermined counts, representing various copy sheet sizes stored in NVM 61, such as the exemplary sheet sizes shown in Table I. Referring to the exemplary sheet sizes, where the count representating the new copy sheet size is equal to or greater than the delta count (i.e. 545) in NVM 61 representing 8.66" size paper, (DELTA@-MACH@CLK>545), 8.66" size paper is presumed to be present and duplex and inverter backstop motors M-2 and M-3 are not operated, (i.e. END). Duplex and inverter backstops 65, 116 respectively accordingly remain in their maximum or HOME position to accommodate 8.66" size paper. Where the delta count is less than the count (i.e. 545) representing 8.66" size paper, the routine (ADJUST BACKSTOP) looks to see if the delta count is greater than the count in NVM 61 representing 8.50" size paper (IF DELTA MACH CLK>535). If so, the copy sheet size is determined to be 8.50" and the backstop motors M-2 and M-3 are energized for an interval of 220 ms. to move backstops 65, 116 forward (RANGE←RANGE 1;/220 MS; DUP FWD←ON).

Where the delta count is less than the count in NVM 61 representing 8.00" paper (IF DELTA@MACH@C-LK<495, THEN BEGIN), the copy sheet size is determined to be 8.00" paper and the backstop motors M-2, M-3 are energized for an interval of 910 ms. to drive backstops 65, 116 forward (RANGE←RANGE 3;/910 MS; DUP FWD←ON). If the delta count is none of the above, the copy sheet size is presumed to be 8.27" and the backstop motors M-2 and M-3 are energized for an interval of 590 mos. to move backstops 65, 116 forward (ELSE BEGIN; RANGE←RANGE 2;/490 MS; DUP FWD←ON).

Referring particularly to FIG. 13, energization of duplex and inverter backstop motors M-2 and M-3 for the preset interval determined drives the duplex and inverter backstops 65, 116 forward (FWD) to the proper position for handling the size copy sheet being processed. Following the preset timed interval, the backstop motors M-2 and M-3 are deenergized to retain duplex and inverter backstops 65, 116 in the adjusted position.

As will be understood, in machines such as reproduction machine 5, plural paper trays (i.e. the main and auxiliary paper trays 34, 36 shown in FIG. 1) may be provided, each capable of supplying copy sheets of a different size. As a result, different size copy sheets may be introduced into the paper path depending upon the paper tray being used at any time. To accommodate a possible change in copy sheet size, whenever either duplex (DUPLEX SELECTED) or inverter (QUANTITY@SELECTED=1) modes are selected, the ADJUST BACKSTOP routine of Table IV is entered to readjust the duplex and inverter backstops 65, 116 respectively in the manner described heretofore.

While adjustment of the duplex and inverter backstops 65, 116 respectively are disclosed as being performed each time either duplex or inverter operational modes are selected by the operator or user, it will be understood that the system may be arranged to store in memory the copy sheet size determined. When either duplex or inverter modes are thereafter selected, a comparison is then made between the previous copy sheet size and the size of the copy sheet being processed to determine if the existing copy sheet sizes are the same. In the event that the copy sheet size remains the same, no resetting of the backstops from their existing position is made. If the comparison reveals that the copy sheet size has changed and therefore that the current position of the duplex and inverter backstops 65, 116 respectively is not correct for the size copy sheet being processed, the new copy sheet is determined and the backstops 65, 116 are reset to the correct position in the manner described heretofore.

details set forth but is intended to cover such modifications or changes as may come within the scope of the following claims.

TABLE I

| Sheet Classification | Sheet Dimension (in direction of sheet feed) Inches | Associated Count Stored in NVM 61 for Comparison |
|---|---|---|
| 1 | 8.66 (220 mm) | >545 |
| 2 | 8.50 (216 mm) | >535, <545 |
| 3 | 8.27 (210 mm) | >495, <535 |
| 4 | 8.00 (203 mm) | <495 |

TABLE II

```
DESCRIPTION:  INITIALIZE PAPER HANDLING MODULE INIT_PHM;
              INITIALIZES PAPER HANDLING INTERLOCKS, AND
              RAISES THE MAIN AND AUX. TRAY (AND DRIVES DUPLEX
              AND INVERTER BACKSTOPS FORWARD)
ENTER;
    START MONITOR_INTERLOCKS;
    IF RDR#INLK = CLOSED THEN BEGIN;
      START MAIN_ELEV (RAISE@TRAY);
      START AUX_ELEV (RAISE@TRAY);
    END; /* IF */
IF (MARKET@REGION & FXMASK) = FX THEN BEGIN;
    DUP$FWD ← ON;
    WAIT 2 SEC;
    DUP$FWD ← OFF;
END; /* IF */
ELSE BEGIN; /* NON-FX MACHINE */
    IF (FEAT@CONFIG & BCKSTP@MASK) = BCKSTOPENABLED THEN BEGIN;
      DUP$FWD ← ON;
      WAIT 600 MS;
      DUP$FWD ← OFF;
    END; /* IF */
  END; /* ELSE */
END; /* ENTER */
```

LEGEND:
= equal to
FX machine intended for foreign sale (i.e. Japan)
DUP FWD Motors M-2, M-3 energized in FORWARD direction to move backstops 65, 116 away from HOME position (WAIT 2 SEC)

While the invention has been described with reference to the structure disclosed, it is not confined to the

TABLE III

CYCLUP_PHM

```
DESCRIPTION:  THE PAPER HANDLING MODULE IS CYCLED_UP
              BY THIS PROCEDURE WHEN START PRINT IS PUSHED
ENTER;
   IF (DIAG@SETUP@INHIBITS & FEED@MASK) = CLEAR THEN BEGIN;
     IF (SIDE@ != SIDE2)   (PURGE@PATH = TRUE) THEN BEGIN;
       IF JOB@SELECTION (TRAY) = MAIN THEN BEGIN;
         START PRF_MN_FDR;
       END;
       ELSE BEGIN; /* MUST BE AUX */
         START PRF_AUX_FDR;
       END;
     END;
     IF (JOB@SELECTION (FORMAT) & (DUPLEX@SELECTED)) != SIMPLEX THEN BEGIN;
       DUP$MTRS ← ON;
       IF (FEAT@CONFIG & BACKSTOP@MASK) = BACKSTOP@IN THEN BEGIN;
         IF (SIDE@ != SIDE2)
           START ADJUST_BACKSTOP;
         END; /* IF */
       END; /* IF */
END; /* IF */
ELSE BEGIN;
       IF ((SADH@DOCUMENT    SADH@SELECTED) = 1) & (QUANTITY@SELECTED = 1) &
       ((JOB@SELECTION (OUTPUT) & OUTPUT@MASK) = TOPTRAY) THEN BEGIN;
           START STATE_HANDLER (FSRSTATE   GOBUSY);
           START ADJUST_BACKSTOP;
           CHK@TRAY@STATUS ← SET;
         END; /* IF */
       END; /* IF */
     END; /* IF */
```

TABLE III-continued

| CYCLUP_PHM |
|---|
| END; /* ELSE */ |

LEGEND:
= equal to
!= not equal to
FX machine intended for foreign sale (i.e. Japan)
PRF MN FDR prefeed main feeder (tray 34)
PRF AUX FDR prefeed auxiliary feeder (tray 36)

TABLE IV

| ADJUST_BACKSTOP; |
|---|

```
ENTER; /* MAIN PROCEDURE */
    CALL MIR_DIGITAL_MC(IO_VAL(PRF#XFER,PAPER@))
RETURNS MSB(FIRST@EVENT@MC),LSB(FIRST@EVENT@MC);
CALL PHR_DIGITAL_MC(IO_VAL(REG#FNGR,TRUE@))
RETURNS MSB(SECOND@EVENT@MC), LSB(SECOND@EVENT@MC);
DELTA@MACH@CLK ← (SECOND@EVENT@MC − FIRST@EVENT@MC);
DELTA@MACH@CLK ← (DELTA@MACH@CLK + PACKWORD(0,CFF@FORM@SIZE));
/* HOME BACKSTOP */
DUP$REV ← ON;
IF MARKET@REGION = RX50 THEN BEGIN;
    RANGE1 ← H50RNG1;
    RANGE2 ← H50RNG2;
    RANGE3 ← H50RNG3;
  WAIT 1200 MS; /* 50 HERTZ */
END; /* IF */
ELSE BEGIN;
    RANGE1 ← H60RNG1;
    RANGE2 ← H60RNG2;
    RANGE3 ← H60RNG3;
    WAIT 1010 MS; /* 60 HERTZ */
END; /* ELSE */
DUP$REV ← OFF;
/* POSITION BACKSTOP */
IF DELTA@MACH@CLK > 545 THEN BEGIN;
END; /* IF */ /* RANGE 0 */
ELSE BEGIN;
    IF DELTA@MACH@CLK > 535 THEN BEGIN;
      RANGE ← RANGE1; /* 220 MS (60) 260 MS (50) */
    END; /* IF */
ELSE BEGIN;
      IF DELTA@MACH@CLK > 495 THEN BEGIN;
        RANGE ← RANGE3; /* 910 MS (60) 1100 MS (50) */
      END; /* IF */
      ELSE BEGIN;
        RANGE ← RANGE2; /* 490 MS (60) 590 MS (50) */
      END; /* ELSE */
    END; /* ELSE */
END; /* ELSE */
WAIT 100 MS;
OPTIMIZE 1;
DUP$FWD ← ON;
WAIT RANGE MS;
DUP$FWD ← OFF;
MOVE@BACKSTOP ← 0;
    /* ENTER */
```

LEGEND:
MIR: MIR 13
MC: Machine Clock (Global Counter 43).
VAL: Value
PRE#XFER: Pretransfer (pretransfer jam detection system 49).
PHR: PHR 11
REG#FNGR: Registration finger 46.
CLK: Clock
← Move right side value (may be a constant or variable) into left side variable.
H50,H60: 50/60 cycle Herz.
RNG: Range (refers to preestablished copy sheet size designations stored in NVM 61.
DUP REV: Duplex Reverse } Motors M-2, M-3 operated in reverse or forward
DUP FWD: Duplex Forward } direction to move backstops 65, 116, toward or away from HOME.

We claim:

1. In a reproduction machine for producing copies having a paper path along which copies being produced move during processing, the paper path including at least one copy processing station having sheet handling means for receiving the copy sheets during processing thereof, said processing station sheet handling means including a receptacle for receiving copy sheets during processing, adjustable sheet stop means for intercepting said copy sheets input to said receptable, and drive means for moving said stop means to adjust the operating dimension of said receptable in the direction of copy sheet movement in accommodation of the size copy sheets being processed, and sheet transport means for moving the copy sheets along the paper path, the combination of:

(a) means to determine the size of the copy sheets being processed from the first one of said copy sheets as said first copy sheet moves along said path;

(b) control means for adjusting the operating dimension of said processing station sheet handling means in accordance with the copy sheet size determined, said control means actuating said drive means to move said stop means and adjust the operating dimension of said receptacle in accordance with the copy sheet size determined; and (c) means establishing a home position for said stop means, said control means actuating said drive means to move said stop means to said home position prior to actuation of said drive means to move said sheet stop means to adjust said receptacle operating dimension.

2. In a reproduction machine for producing copies having a paper path along which copies being produced move during processing, the paper path including at least one copy processing station having sheet handling means for receiving the copy sheets during processing thereof, said processing station sheet handling means including a receptacle for receiving copy sheets during processing, adjustable sheet stop means for intercepting said copy sheets input to said receptacle, and drive means for moving said stop means to adjust the operating dimension of said receptacle in the direction of copy sheet movement in accommodation of the size copy sheets being processed, and sheet transport means for moving the copy sheets along the paper path, the combination of:

(a) means to determine the size of the copy sheets being processed from the first one of said copy sheets as said first copy sheet moves along said path;

(b) control means for adjusting the operating dimension of said processing station sheet handling means in accordance with the copy sheet size determined, said control means actuating said drive means to move said stop means and adjust the operating dimension of said receptacle in accordance with the copy sheet size determined;

(c) means establishing a home position for said sheet stop means, said control means including means responsive to start up of said machine to actuate said drive means and move said stop means away from said home position to an unknown position; and (d) means to enable selective operation of said copy processing station, said control means including means responsive to selection of said processing station to reverse said drive means to move said stop means to said home position, and following determination of the size copy sheets being processed to actuate said drive means to move said stop means from said home position to adjust the operating dimension of said receptacle in accordance with the copy sheet size determined.

3. In a reproduction machine for producing copies having a paper path along which copies being produced move during processing, the paper path including at least one copy processing station having sheet handling means for receiving the copy sheets during processing thereof, said processing station sheet handling means including a receptacle for receiving copy sheets during processing, adjustable sheet stop means for intercepting said copy sheets input to said receptacle, and drive means for moving said stop means to adjust the operating dimension of said receptacle in the direction of copy sheet movement in accommodation of the size copy sheets being processed, and sheet transport means for moving the copy sheets along the paper path, the combination of:

(a) means to determine the size of the copy sheets being processed from the first one of said copy sheets as said first copy sheet moves along said path;

(b) control means for adjusting the operating dimension of said processing station sheet handling means in accordance with the copy sheet size determined, said control means actuating said drive means to move said stop means and adjust the operating dimension of said receptacle in accordance with the copy sheet size determined;

(c) means establishing a home position for said sheet stop means, said control means including means responsive to start up of said machine to actuate said drive means and move said stop means away from said home position to an unknown position;

said means to determine copy sheet size including a counter for tolling a count in response to operation of said machine;

memory means for storing selected counts from said counter; and first and second copy sheet sensors at predetermined points along said paper path for monitoring movement of copy sheets along said paper path, said first and second copy sheet sensors outputting the count on said counter to said memory means in response to movement of said first one of said copy sheet therepast whereby to provide counts representative of the size of said first copy sheet and the copy sheets being processed and permit said control means to move said stop means and adjust the operating dimension of said receptacle in accordance with the copy sheet size determined.

4. A method of producing copies wherein images are electrostatically created, developed, and transferred to copy sheets moving along a predetermined path with at least one receptacle having an adjustable backstop for receiving copy sheets during processing, comprising the steps of (a) moving said backstop to a home position (b) determining the size of the first one of the copy sheets as representative of the size of the copy sheets to be processed as the first copy sheet is moving along said path by (1) detecting the first copy sheet at a first predetermined position along said paper path and recording a first count;

(2) detecting the first copy sheet at a second predetermined point along said paper path and recording a second count;

(3) subtracting said first and second counts to provide a sheet count representative of the copy sheet size; and (4) comparing said sheet count with predetermined counts representative of different copy sheet sizes to identify the size copy sheet being processed; and (c) following homing of said backstop, moving said backstop to a preset position corresponding to the size copy sheet determined.

* * * * *